US006494587B1

(12) United States Patent
Shaw et al.

(10) Patent No.: US 6,494,587 B1
(45) Date of Patent: Dec. 17, 2002

(54) COLD CATHODE BACKLIGHT FOR AVIONICS APPLICATIONS WITH STROBE EXPANDED DIMMING RANGE

(75) Inventors: James E. Shaw, Ely, IA (US); William G. Perreault, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 71 days.

(21) Appl. No.: 09/645,083

(22) Filed: Aug. 24, 2000

(51) Int. Cl.[7] ..... F21V 7/04

(52) U.S. Cl. ..... 362/29; 362/260; 362/471; 362/561

(58) Field of Search ..... 362/29, 30, 260, 362/470, 471, 561, 26, 27

(56) References Cited

U.S. PATENT DOCUMENTS 3,191,147 A * 6/1965 Majendie ..... 362/471
5,143,433 A * 9/1992 Farrell ..... 362/29
5,677,603 A * 10/1997 Speirs et al. ..... 362/471
5,720,545 A 2/1998 Shaw ..... 362/245
5,886,681 A * 3/1999 Walsh et al. ..... 362/29
6,039,451 A 3/2000 Grave ..... 362/29
6,050,704 A * 4/2000 Park ..... 362/29
6,247,825 B1 * 6/2001 Borkowski ..... 362/471

* cited by examiner

*Primary Examiner*—Sandra O'Shea
*Assistant Examiner*—Peggy Neils
(74) *Attorney, Agent, or Firm*—Nathan O. Jensen; Kyle Eppele

(57) ABSTRACT

A method of backlighting a flat panel display over an expanded dimming range includes providing a backlight including multiple cold cathode fluorescent lamps positionable directly behind a diffuser. Each of multiple drive circuits is adapted to independently adjust arc current of at least one of the multiple cold cathode fluorescent lamps in order to change the luminance output of the at least one of the cold cathode fluorescent lamps. Control signals are provided to each of the multiple drive circuits to separately control luminance output of different cold cathode fluorescent lamps such that at the same instant the different cold cathode fluorescent lamps are driven to substantially different luminance intensities, thereby allowing a reduction of an overall minimum luminance provided by the backlight and expanding the dimmable range of the backlight. A backlight implementing the methods of the invention is also disclosed.

14 Claims, 6 Drawing Sheets

COLD CATHODE BACKLIGHT FOR AVIONICS APPLICATIONS WITH STROBE EXPANDED DIMMING RANGE

FIELD OF THE INVENTION

The present invention relates to display backlighting systems. More particularly, the present invention relates to a cold cathode fluorescent lamp backlighting system providing an expanded dimming range.

BACKGROUND OF THE INVENTION

Liquid crystal displays (LCDs) are frequently used as display devices in aircraft. To accommodate low level night operation and high ambient sunlight conditions, an extremely large backlight dimming range is typically necessary. A desired dynamic luminance range ratio of 3000:1 (the ratio of the highest luminance output to the lowest possible luminance output) or more is highly desirable.

Cold cathode fluorescent lamp technology has long been a source of lighting for the laptop personal computer (PC) industry which requires long life, efficient operation, an inexpensive cost structure, but only limited dimability. The fact that these lamps are difficult to dim over more than a range of 500:1 has precluded their usage in most aviation electronics (avionics) applications which require significantly more dynamic luminance range. While some avionics manufacturers have been successful in putting cold cathode lamps in flight deck applications, the dimming performance (typically no greater than 1000:1) has precluded their application to a primary flight display on which critical pilot information is provided.

SUMMARY OF THE INVENTION

A method of backlighting a flat panel display over an expanded dimming range includes providing a backlight including multiple cold cathode fluorescent lamps positionable directly behind a diffuser. Each of multiple drive circuits is adapted to independently adjust arc current of at least one of the multiple cold cathode fluorescent lamps in order to change the luminance output of the at least one of the cold cathode fluorescent lamps. Control signals are provided to each of the multiple drive circuits to separately control luminance output of different cold cathode fluorescent lamps such that at the same instant the different cold cathode fluorescent lamps are driven to substantially different luminance intensities, thereby allowing a reduction of an overall minimum luminance provided by the backlight and expanding the dimmable range of the backlight. A backlight implementing the methods of the invention is also disclosed.

DETAILED DESCRIPTION OF AN ILLUSTRATIVE EMBODIMENT

Figure 1:
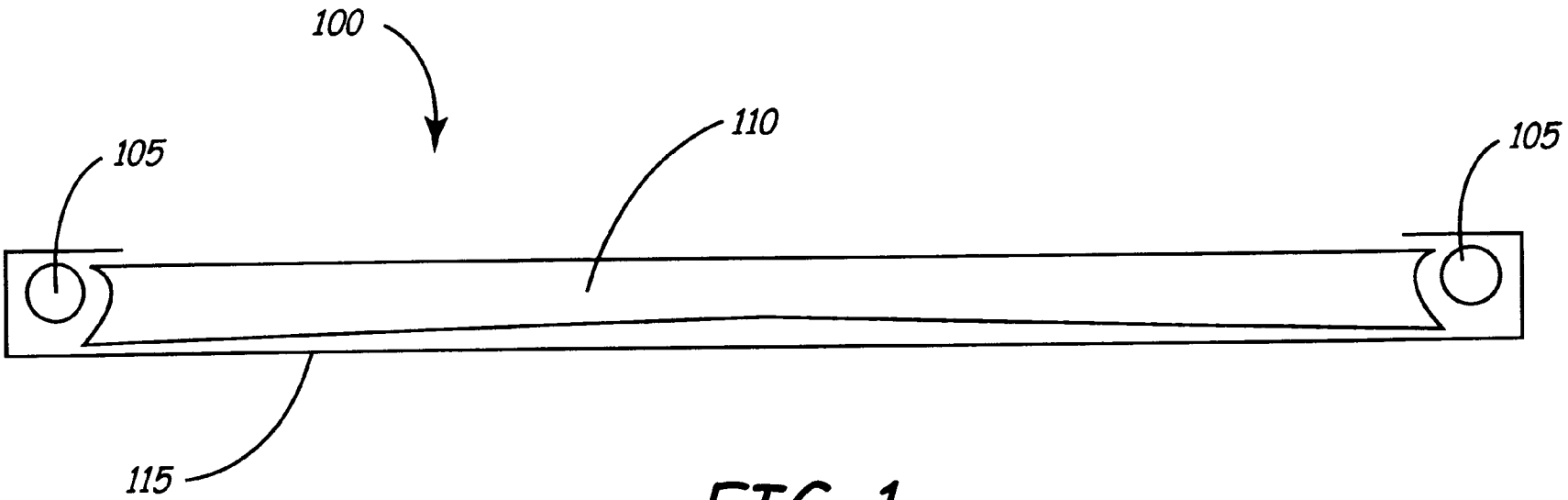
FIG. 1 PRIOR ART
FIG. 1 is a diagrammatic top view illustrating a prior art edge lighting cold cathode backlight.

FIG. 1 is a diagrammatic illustration of a prior art cold cathode backlight 100. Backlight 100 includes cold cathode fluorescent lamps (CCFL) 105, which in the illustrated embodiment are stick lamps, positioned on the ends of a double polycarbonate light-piping wedge 110. In conjunction with reflector 115 and optical films, backlight 100 can generally uniformly illuminate displays in laptop PCs. This type of lamp is used in most laptop PC applications because they are inexpensive (typically in the neighborhood of $3–$7 per lamp), efficient and have simple drive circuit requirements (no filaments and limited dimming). Obviously, one significant advantage to this approach is a limited depth required for backlighting the LCD. However, backlights such as backlight 100 typically cannot provide the dimable range, sufficient luminance or suitable lamp life required for primary flight displays in which critical pilot information is provided.

Figure 2A:
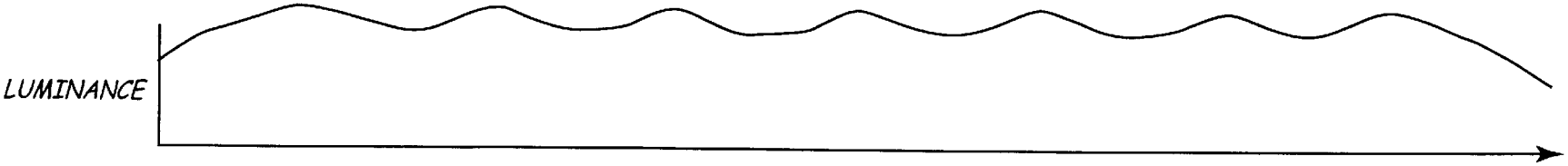
FIG. 2A is a plot illustrating luminance verses position for a cold cathode backlight of the present invention shown in FIG. 2B.
Figure 2B:
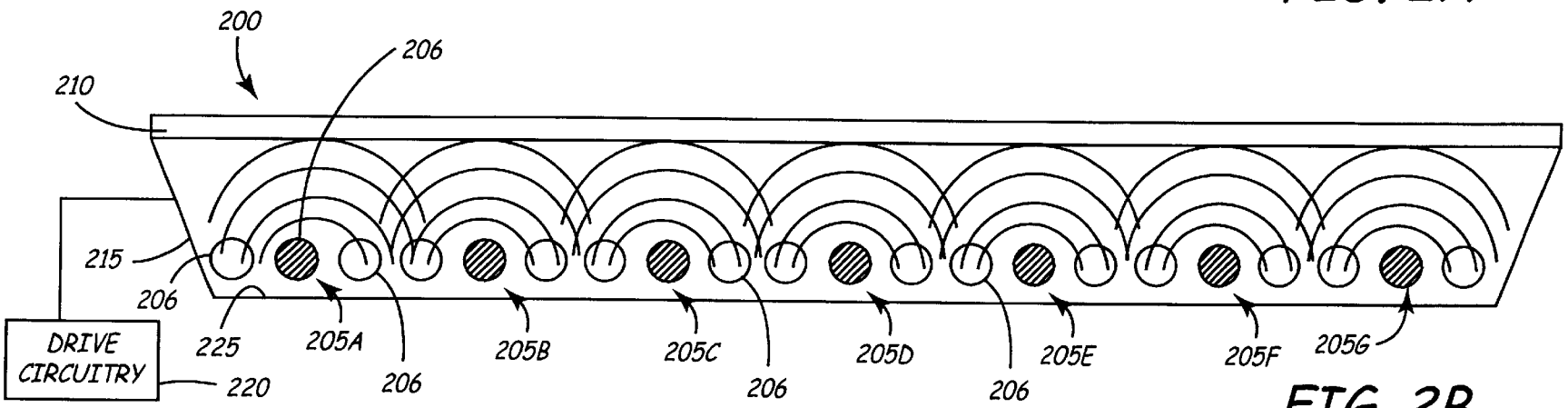
FIG. 2B is a diagrammatic top view illustrating a cold cathode backlight in accordance with the present invention.

FIG. 2B is a top diagrammatic illustration of a CCFL backlighting system 200 in accordance with the present invention. Backlighting system 200 includes multiple banks 205 of CCFL 206. Each bank 205 of lamps (banks 205A–205G are shown) includes one or more CCFL 206 which are arranged behind diffuser 210 to allow time sequenced firing (application of energy to achieve a luminous output) of the lamp array in such a way to allow the pilot's eye response function to integrate the luminance between lamp firings. In the illustrated embodiment, each of banks 205A–205G includes three CCFL 206. However, more or fewer lamps in each bank can be used. Also, while the lamps in each bank are shown to be sequentially or adjacently positioned to one another in groups of three, in other embodiments the lamps in a particular bank can be spread out within display housing 215 such that the banks of lamps overlap or are staggered, providing enhanced distribution of light.

In order to provide time sequenced firing of the lamp array in such a way as to allow the pilot's eye response function to integrate the luminance between lamp firings, drive circuitry 220 drives the banks 205 of lamps 206 using the methods of the present invention. The control circuitry illustrated in FIGS. 4 and 5 controls the drive circuitry. The time sequenced firing aspects of the present invention work in much the same way as a cathode ray tube (CRT) or LCD is matrix addressed in visual space to be perceived as a steady picture. In CRTs and LCDs, the picture remains steady even though the luminance of each row or position on the screen fluctuates over time. The advantage of this method is to keep the current levels high in the lamp, which promotes stability and consistency while still being able to dim the lamps. The lamps become more difficult to dim as they are operated in a region of instability (high voltages, low currents, high ion recombination at the wall). By selectively choosing the lamp spacing from the diffuser 210, the spacing between adjacent lamps, and the spacing between the lamps and reflector 225 positioned behind lamp banks 205, as well as by selectively choosing the minimum lamp current, uniform luminance performance can be achieved using the methods of the present invention.

In accordance with embodiments of the present invention, dimming of backlight system 200 is accomplished using at least one, and typically all, of five complimentary methods:

1) The arc current in the lamps is adjusted to change the electron density within the tubes, and thereby to change the light output as is known in the art;
2) The lamps are fired in a stroboscopic fashion for a short period of time which is above the eye's critical flicker frequency of approximately 100 Hz;
3) The arc current is adjusted unequally between banks 205 of stick lamps to change the light output of one lamp as opposed to its neighboring lamp;
4) Banks of lamps are fired (by skipping every other lamp for instance) for a short period of time; and
5) Individual lamps or banks of lamps are provided with their own drive circuit, thus allowing for any of the lamps to be fired at any one time independently of other lamps.

It is important that consideration be given to specific lamp spacing and placement in order to extend the dimming range of backlight system 200 using techniques (2), (3) and (4) listed above. Failure to provide proper consideration could lead to non-uniformed luminance artifacts within the display that would be objectionable in a primary flight display application. Key to this effort is in uniformly radiating the diffuser 200 with light, regardless of the strobe frequency and lamp bank 205 used at any one time.

Figure 2C:
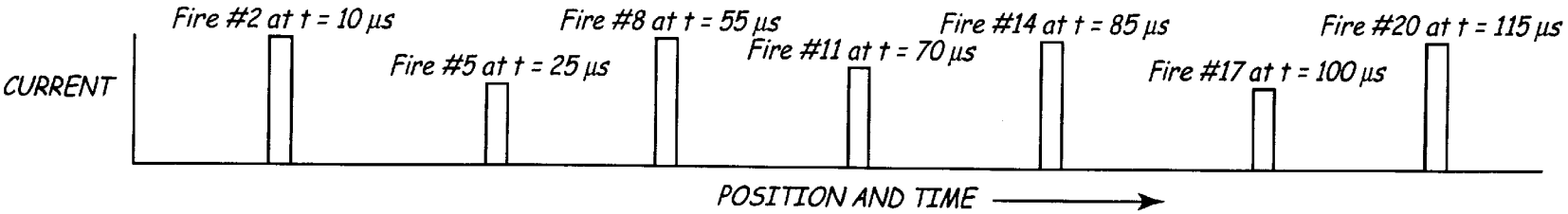
FIG. 2C is a timing diagram illustrating a firing sequence of the cold cathode lamps of the backlight shown in FIG. 2B in accordance with one method of operation of the present invention.

FIG. 2C is a plot which diagrammatically illustrates the firing of each of lamp banks 205A, 205B, 205C, 205D, 205E, 205F and 205G at differing times and using differing drive currents in one exemplary embodiment. In FIG. 2C the sequentially shown drive periods and drive current amplitudes correspond to the positions of the respective banks 205A–205G of CCFL. This provides a general understanding of the concepts of the present invention. The following discussion provides a more specific description of these methods.

Figure 3:
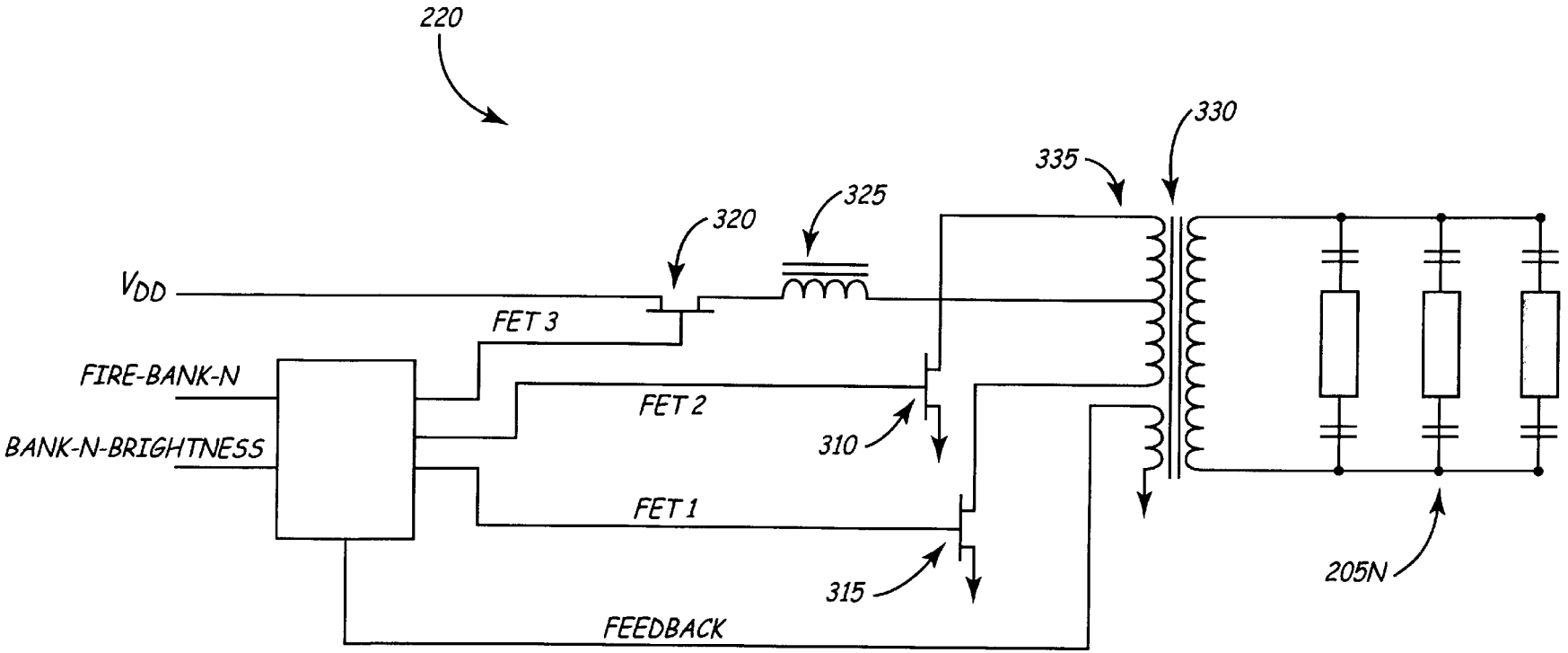
FIG. 3 is a circuit diagram illustrating a circuit which can be used to implement a method of the present invention.

FIG. 3 is a schematic diagram which diagrammatically illustrates circuitry 300 which can be used to accomplish dimming of the backlight system using method (1) of adjusting the arc current to change the electron density within a tube to thereby change the light output as is conventionally done. Drive circuit 300 includes drive control circuitry 305, switching field effect transistors (FETs) 310, 315 and 320, coil 325 and transformer 330. In drive circuit 300, control circuit 305 is fed three signals, Fire_Bank_N, Bank_N_Brightness, and Feedback. The first signal Fire_Bank_N, controls the frequency of the drive, which is fixed for method (1). Signal Fire_Bank_N can be considered a clock signal. The second signal, Bank_N_Brightness, provides a reference for the control circuitry. The control circuitry compares the Feedback signal to the Bank_N_Brightness signal to determine how long each of switching FETs 310, 315 and 325 are turned on. In the circuit, FETs 315 and 310, as controlled by signals FET1 and FET2, along with the primary side 335 of transformer 330 to form a push-pull converter. Under the control signal FET3, FET 320 is used as the main power input switch, and is thereby used to control the current ultimately supplied to the lamps (lamp bank 205N as illustrated). The Feedback portion of transforming 330 is wound with the primary coils 335 to provide feedback on the current flowing through the primary side. In backlight system 200 of the present invention, drive circuitry 220 includes a separate drive circuit 300 for each of N bank of lamps.

Figure 4:
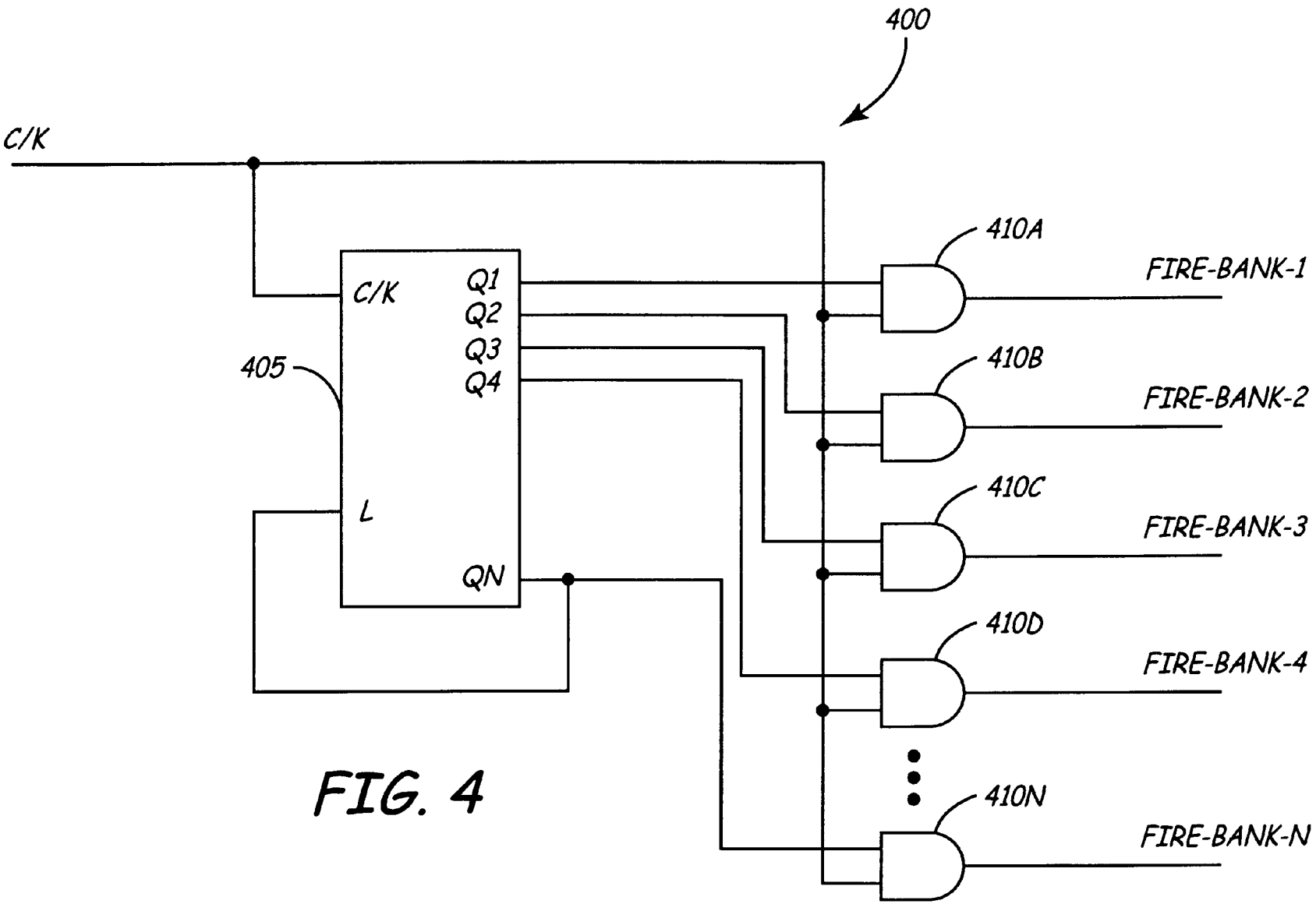
FIG. 4 is a circuit diagram illustrating a circuit which can be used to implement a further method of the present invention.

To achieve method (2) of firing the lamps in a stroboscopic fashion, each bank 205 of lamps is fired sequentially across the luminaire. FIG. 4 is a schematic diagram of a circuit 400 which can be used to implement this method. A primary clock signal, hereby referred to as Clk, is fed to the clock input of a shift register 405. The shift register 405 is initialized to rotate a clock signal logic "1" through outputs Q1–QN in a circular fashion, thereby changing which bank is allowed to fire with each clock pulse. Each of the respective outputs Q1–QN are fed along with clock signal Clk through a logical AND gate 410 to provide the N Fire_Bank_N outputs for the N banks 205 of lamps. Each of the firing signals Fire_Bank_N is then fed to the corresponding bank drive circuit 300. Equation 1 shown below can be used to determine which frequencies may be used when firing the banks of lamps to avoid physical flicker.

$$F_{Clk} \geqq F_{LN} > F_E N \qquad \text{EQ. 1}$$

Where, $F_L$=minimum lamp frequency to provide uniform light single lamp;

$F_E$=minimum frequency before the eye can detect flicker;

N=number of lamp banks in backlight system; and $F_{Clk}$=clock frequency example:

$F_E$=120 Hz $F_L$=300 Hz

N=6

$F_{Clk} \geqq 1800$ Hz>720 Hz.

Figure 5:
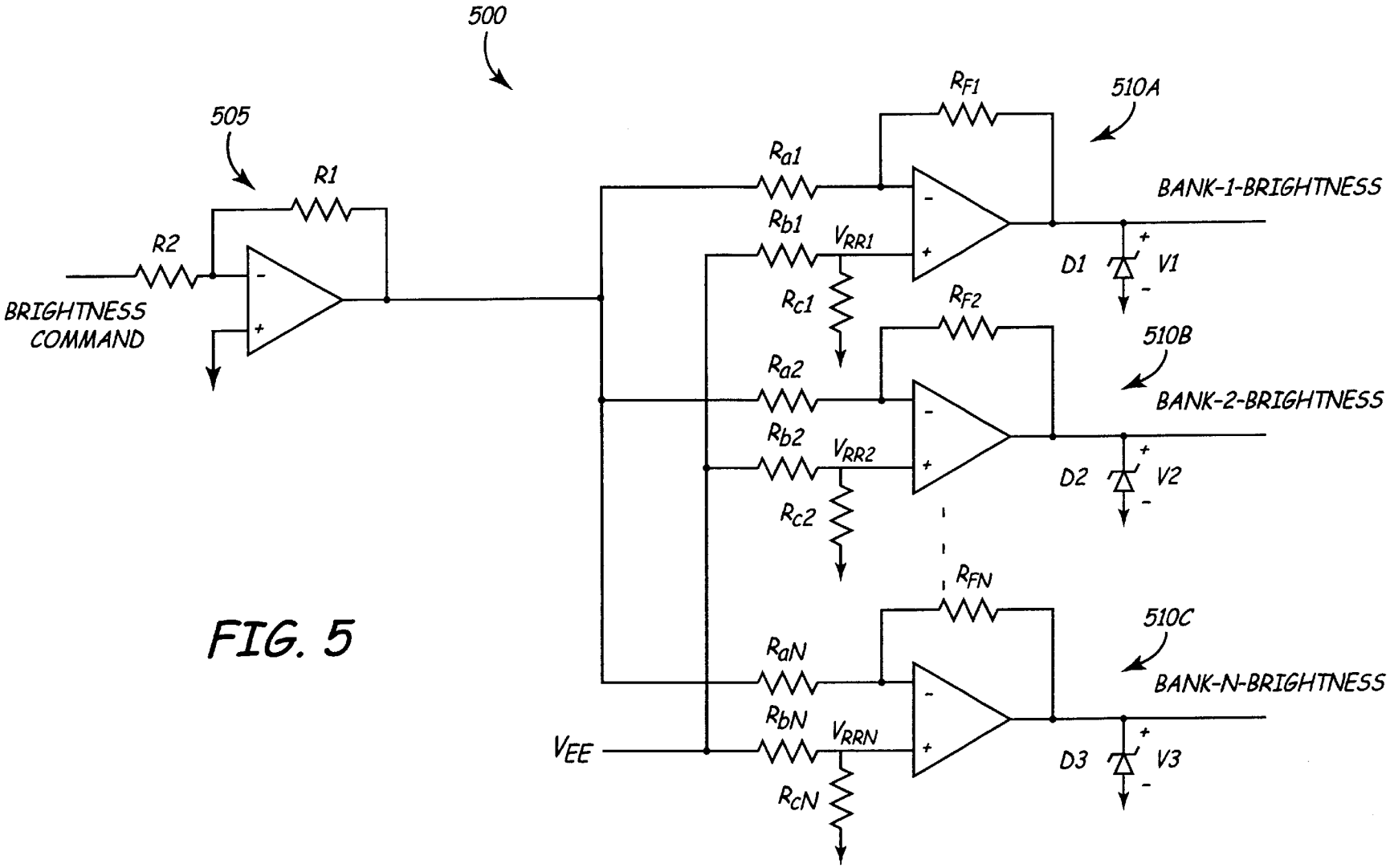
FIG. 5 is a circuit diagram which illustrates a circuit which can be used to implement another method of the present invention.

FIG. 5 is a schematic diagram of a circuit 500 which can be used to implement method (3) of adjusting the arc current unequally between banks of stick lamps to change the light output of one lamp as opposed to its neighboring lamp. Circuit 500 includes an inverting amplifier 505 having a gain established by resistors $R_1$ and $R_2$. Inverting amplifier 505 receives a brightness control signal Brightness_Command as an input and provides an inverted and amplified version of this signal as an output. Circuit 500 also includes a differential amplifier 510 (510A–510N are shown) for each of the N banks of lamps in the backlighting system. Each differential amplifier 510 includes resistors $R_{aN}$, $R_{fN}$, $R_{bN}$ and $R_{CN}$, and receives a reference signal $V_{EE}$ at its non-inverting input side. Each of amplifiers 510 provide one of the N respective brightness control signals Bank_N_Brightness as an output.

Figure 6:
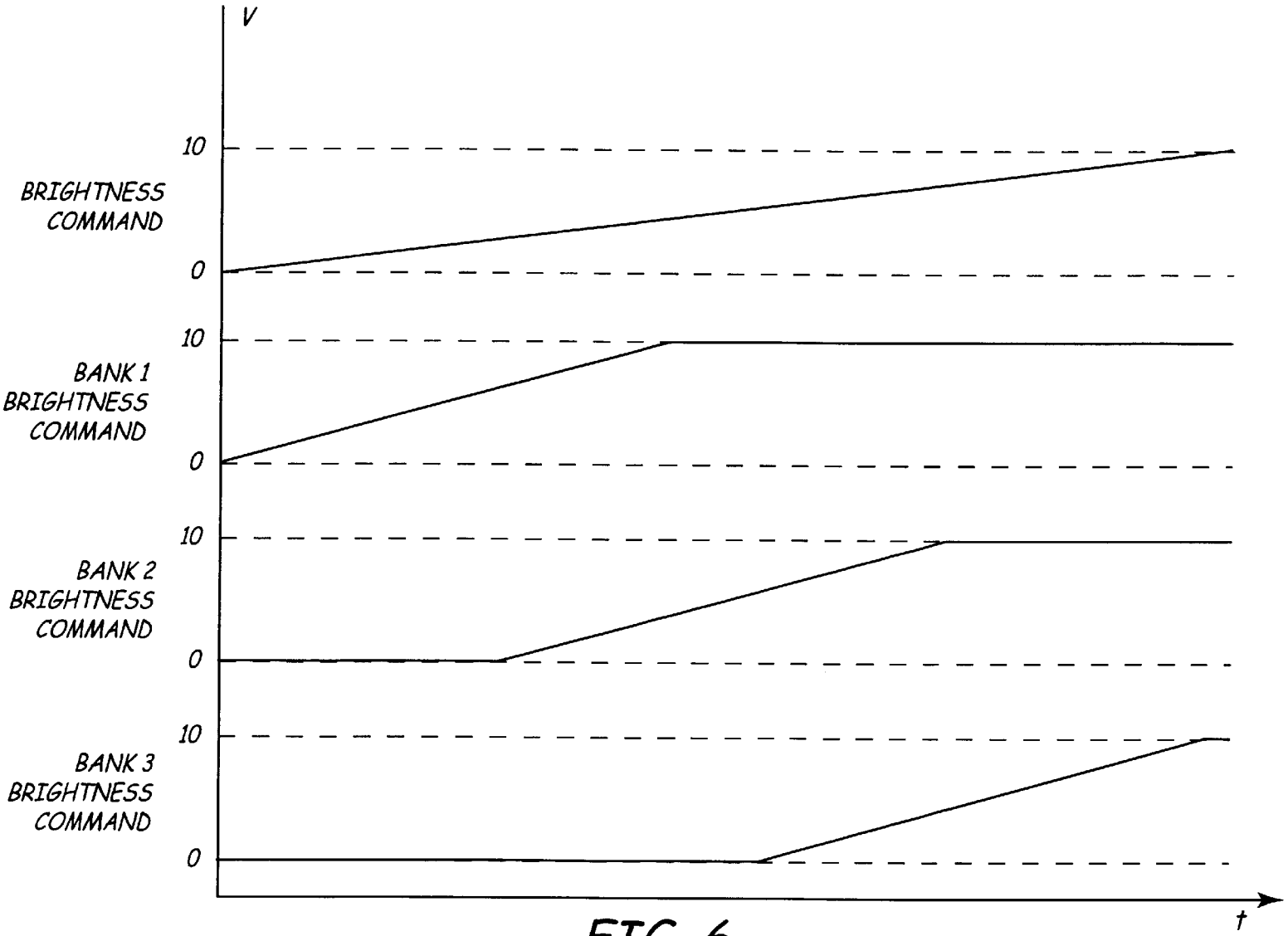
FIG. 6 is a series of plots illustrating operation of the circuit shown in FIG. 5.

To achieve a wider dimming range, the banks of lights are brought up in luminance at different times. Shown in FIG. 6 is an example of how a three-bank design can operate using a control circuit such as shown in FIG. 5 to provide the Brightness_Command signal to the drive circuits. Obviously, this can be extended to designs having more than three banks of lamps. The produced brightness signals are passed on to the individual lamp drive circuits, for example such as the circuits 300 shown in FIG. 3. Referring again to FIG. 5, on each of output amplifiers 510, an offset $V_{EE}$ is placed on the positive terminal. This delays when the output of the amplifier begins to climb. In examples shown in FIG. 6, the first amplifier 510A has a zero offset. Its output accounts for just over one-third of the main brightness commands input range. After that point, it is clamped by diode $V_1$ to a maximum output level. The second amplifier 510 has an offset applied to it in order to delay the rise in its output signal until the main input Brightness_Command reaches just under a third of its fullscale value. The output is then clamped using diode $D_2$ to a maximum value when the main input Brightness_Command reaches two-thirds of full scale. The third illustrated amplifier 510N (where N=3) handles the final third of the main Brightness_Command's input range as shown. The values of the resistors in each of amplifiers 510 can be selected to tailor the manner in which the Bank_N_Brightness signals are generated. This method allows for each bank to add to the others contribution of light output in varying amounts. Also, as is shown in FIG. 6, there is an overlap between when each bank of laps is enabled. This provides for a much smoother transition from when one bank reaches its top luminance to when the next adds its own light, without having to start precisely when the first reaches its maximum value, thus preventing visible flicker.

As discussed above, the present invention includes methods of dimming a backlight containing CCFL by utilizing spacing and stroboscopic sequencing of the lamps to provide dynamic dimming ranges which are adequate for primary flight displays. In embodiments of these methods, unequal current distribution between lamps, as well as the appropriate lamp spacing, allow both low current circuits and high current circuits to enhance the dimming range of the backlight to provide the required primary flight display dynamic dimming ranges. Further, one bank of lamps in the backlight (for example, bank 205D) can incorporate a phosphor blend that is optimized for specific applications, such as night vision displays. These lamps are utilized at all times, but only this bank of lamps is utilized during night vision (NVIS) flight.

Although the present invention has been described with reference to illustrative embodiments, workers skilled in the art will recognize that changes may be made in form and detail without departing from the spirit and scope of the invention.

What is claimed is:

1. A method of backlighting a flat panel display over an expanded dimming range, the method comprising:

providing a backlight including a plurality of cold cathode fluorescent lamps positionable directly behind a diffuser;

providing a plurality of drive circuits, wherein each of the plurality of drive circuits is adapted to adjust arc current of at least one of the plurality of cold cathode fluorescent lamps to change an electron density in the at least one of the plurality of cold cathode fluorescent lamps and to thereby change a luminance output of the at least one of the plurality of cold cathode fluorescent lamps; and providing control signals to each of the plurality of drive circuits to separately control luminance outputs of different ones of the plurality of cold cathode fluorescent lamps such that at the same instant the different ones of the plurality of cold cathode fluorescent lamps are driven to substantially different luminance intensities, thereby reducing an overall minimum luminance provided by the backlight and expanding the dimmable range of the backlight.

2. The method of claim 1, wherein the plurality of cold cathode fluorescent lamps includes multiple banks of cold cathode fluorescent lamps, and wherein providing the plurality of drive circuits further comprises providing the plurality of drive circuits such that each of the plurality of drive circuits is adapted to adjust the arc current of each cold cathode fluorescent lamp in one corresponding bank of lamps to thereby change the luminance output of each cold cathode fluorescent lamp in the one corresponding bank of lamps.

3. The method of claim 2, wherein providing the control signals to each of the plurality of drive circuits further comprises providing the control signals to fire the banks of lamps stroboscopically sequentially across the backlight.

4. The method of claim 3, wherein providing the control signals to fire the banks of lamps stroboscopically sequentially across the backlight further comprises providing the control signals to fire each of the banks of lamps sequentially and substantially one bank at a time.

5. The method of claim 3, wherein providing the control signals to fire the banks of lamps stroboscopically sequentially across the backlight further comprises providing the control signals to fire each of the banks of lamps at a frequency which is greater than a minimum frequency at which the human eye can visibly detect flicker.

6. The method of claim 5, wherein providing the control signals further comprises providing the control signals such that each of the plurality of banks of lamps is brought up in luminance at different and overlapping times.

7. The method of claim 2, wherein one of the multiple banks of lamps includes lamps having a phosphor blend which is optimized or filtered for night vision applications, wherein providing the control signals to each of the plurality of drive circuits to separately control luminance outputs further comprises providing the control signals such that only the bank of lamps having the phosphor blend optimized for night vision applications is illuminated during night vision operation.

8. A backlight for backlighting a flat panel display over an expanded dimming range, the backlight comprising:

a diffuser;

a plurality of cold cathode fluorescent lamps positioned directly behind the diffuser;

a plurality of drive circuits, where each of the plurality of drive circuits is adapted to adjust arc current of at least one of the plurality of cold cathode fluorescent lamps to change an electron density in the at least one of the plurality of cold cathode fluorescent lamps and to thereby change a luminance output of the at least one of the plurality of cold cathode fluorescent lamps; and control circuitry providing control signals to each of the plurality of drive circuits to separately control luminance outputs of different ones of the plurality of cold cathode fluorescent lamps such that at the same instant the different ones of the plurality of cold cathode fluorescent lamps are driven to substantially different luminance intensities, thereby reducing an overall minimum luminance provided by the backlight and expanding the dimmable range of the backlight.

9. The backlight of claim 8, wherein the plurality of cold cathode fluorescent lamps includes multiple banks of cold cathode fluorescent lamps, and wherein each of the plurality of drive circuits is adapted to adjust the arc current of each cold cathode fluorescent lamp in one corresponding bank of lamps to thereby change the luminance output of each cold cathode fluorescent lamp in the corresponding one bank of lamps.

10. The backlight of claim 9, wherein the control circuitry is adapted to provide control signals to each of the plurality of drive circuits such that the banks of lamps are fired stroboscopically sequentially across the backlight.

11. The backlight of claim 10, wherein the control circuitry is adapted to provide the control signals to the plurality of drive circuits such that the banks of lamps are fired sequentially and one bank at a time.

12. The backlight of claim 10, wherein the control circuitry is adapted to control the plurality of drive circuits such that the banks of lamps are fired stroboscopically sequentially across the backlight at a frequency which is greater than a minimum frequency at which the human eye can visibly detect flicker.

13. The backlight of claim 9, wherein the control circuitry is adapted to provide the control signals to control each of the plurality of drive circuits such that each of the plurality of banks of lamps is brought up in luminance during different and overlapping time periods.

14. The backlight of claim 9, wherein one of the multiple banks of lamps comprises lamps having a phosphor blend which is optimized or filtered for night vision applications, and wherein the control circuitry is adapted to provide the control signals to control each of the plurality of drive circuits such that only the bank of lamps having the phosphor blend optimized for night vision applications is illuminated during night vision operation.

* * * * *